United States Patent [19]

May

[11] Patent Number: 4,885,045

[45] Date of Patent: Dec. 5, 1989

[54] ALUMINIUM ALLOYS SUITABLE FOR SACRIFICIAL ANODES

[75] Inventor: Robin F. May, Greensborough, Australia

[73] Assignee: Comalco Aluminum Limited, Melbourne, Australia

[21] Appl. No.: 206,353

[22] Filed: Jun. 14, 1988

[30] Foreign Application Priority Data

Jun. 16, 1987 [AU] Australia ..... PI2511

[51] Int. Cl.[4] ..... C22C 21/00

[52] U.S. Cl. ..... 148/440; 148/439; 420/532; 420/541

[58] Field of Search ..... 420/541, 532; 148/439, 148/440

[56] References Cited

FOREIGN PATENT DOCUMENTS 42-14291 8/1987 Japan .

*Primary Examiner*—R. Dean

*Attorney, Agent, or Firm*—Larson and Taylor

[57] ABSTRACT

Aluminium alloys particularly useful as sacrificial anodes and processes for the preparation thereof are disclosed. The alloys of the invention exhibit a range of superior properties enabling high performance and reliability under a wide range of environmental conditions.

11 Claims, 6 Drawing Sheets

ALUMINIUM ALLOYS SUITABLE FOR SACRIFICIAL ANODES

Figure 1:
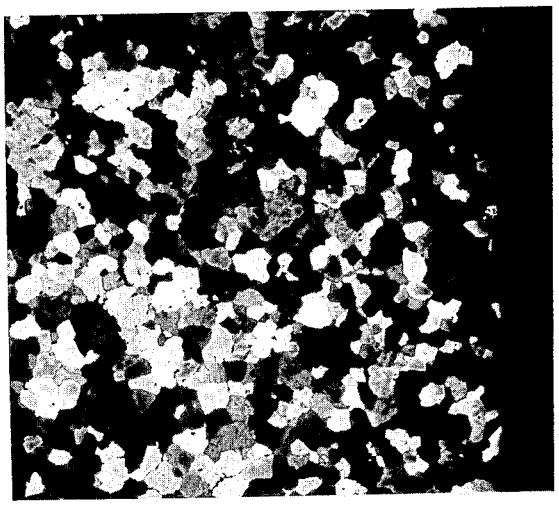
Figure 2:
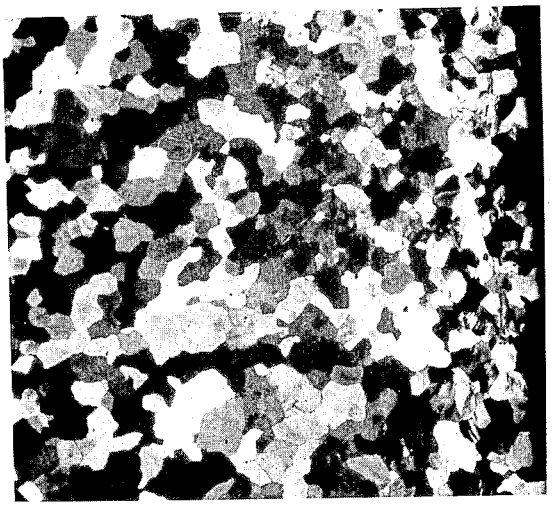
Figure 3:
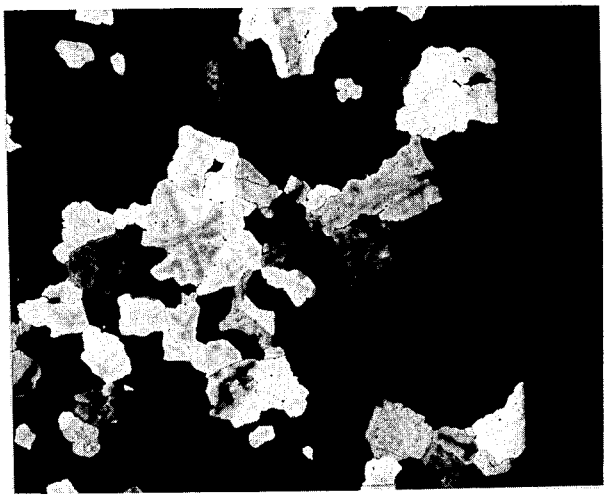
Figure 4:
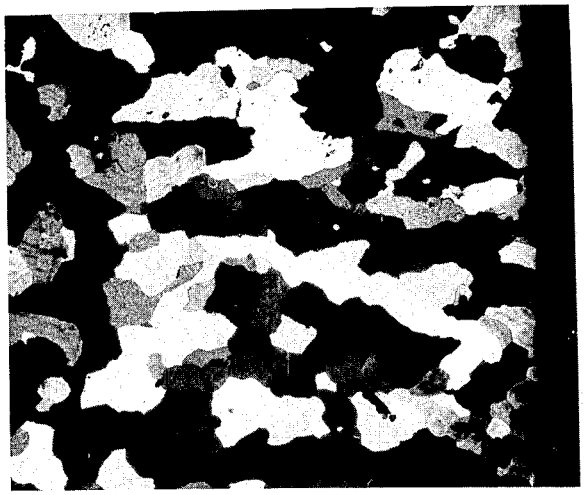
Figure 5:
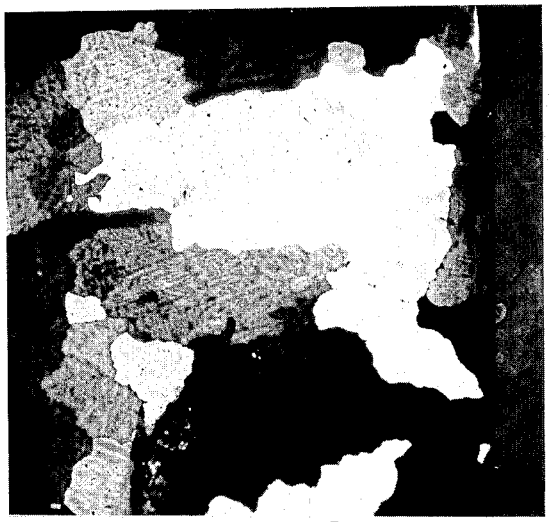
Figure 6:
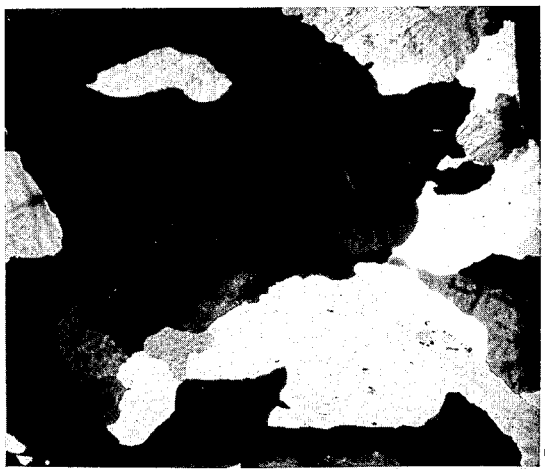
Figure 7:
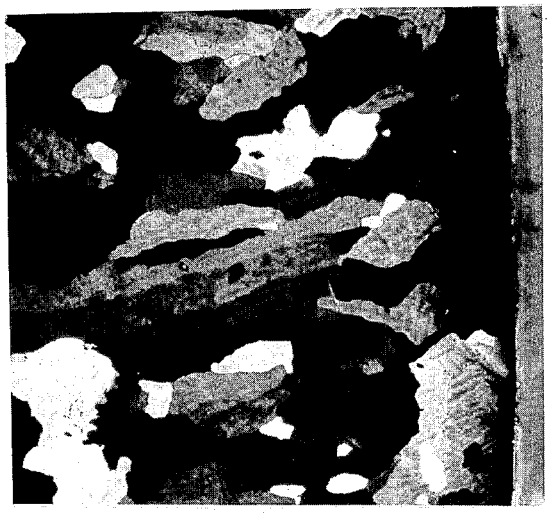
Figure 8:
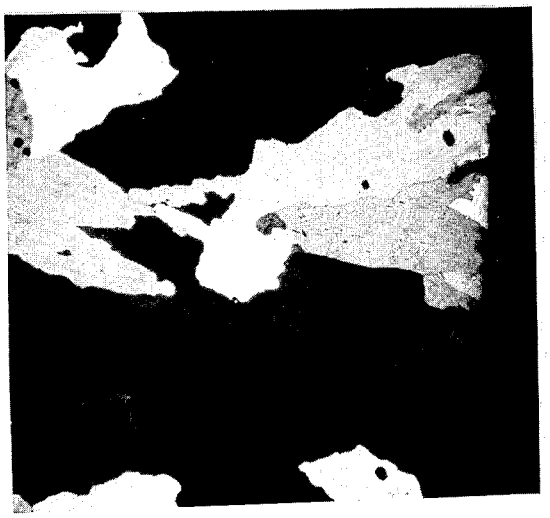
Figure 9:
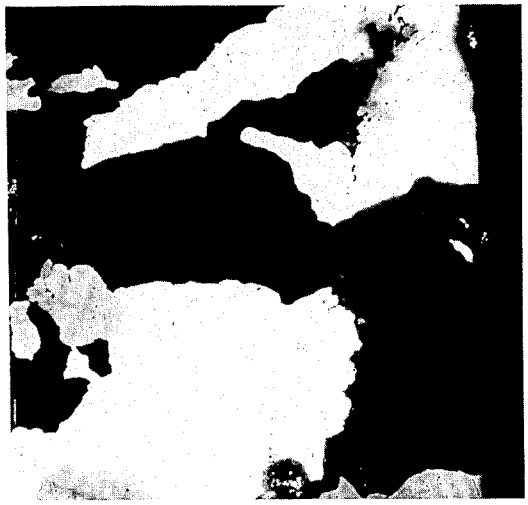

This invention relates to aluminium alloys.

The alloys of the invention are particularly useful as sacrificial anodes, but they are also useful for other applications such as anode materials for primary batteries and sacrificial coatings for ferrous structures.

The most important properties of a sacrificial anode alloy are a high electronegative potential and high electrochemical capacity. These characteristics determine the driving voltage available for protecting the structure and the quantity of electric current available per unit mass of anode respectively. In addition, the anode should be uniformly consumed and exhibit constancy of performance during its life.

The alloys of this invention possess a comprehensive range of enhanced properties enabling high performance and reliability to be obtained under a wide range of environmental conditions including:

low temperature seawater
low temperature saline mud
ambient temperature seawater
ambient temperature saline mud
high temperature seawater
high temperature saline mud
low salinity seawater.

The alloys of this invention have improved properties and are characterised, in particular, by possessing:

a high electrochemical capacity/utilisation coefficient
high operating potential
increased tolerance to nobler metal impurities (e.g. Fe, Cu)
an ability to be cast from lower purity aluminium feedstock (e.g. 99.70–99.85%) with minimal effect on performance
reliable and consistent performance characteristics
negligible susceptibility to delayed cracking.

In addition, the alloys require no heat-treatment and can therefore be used in the as-cast condition.

We have developed the alloys of this invention as the result of a clearer understanding of the interaction of the many factors which are instrumental in conferring optimal dissolution characteristics on alloys for sacrificial corrosion protection.

While there are a number of similar alloys which have some, but not all, of the above-mentioned favourable properties, none, to our knowledge, have all these properties in the one alloy.

In the prior art, the alloy with the highest known electrochemical capacity for marine protection is an Al—Hg—Zn alloy. This alloy, however, operates at a lower driving potential than the alloy of this invention and in addition, releases mercury (a toxic heavy metal) into the environment. Anode dissolution is also less uniform which increases the tendency for metal wastage through undercutting. Another alloy based on Al—In—Zn, operates at a higher driving potential than the first-mentioned alloy but does not possess the same high electrochemical capacity.

As indicated above, by electrochemical capacity is meant the amount of current per unit mass of anode material which can be supplied to the metallic structure being protected.

Variations in the compositions of these known alloys have been attempted to improve anode performance in harsh environments (e.g. high temperature sea-water and saline mud) and to increase their tolerance to iron impurities. However, at this point in time there is no single known alloy which exhibits the range of properties exhibited by the alloy of the invention.

An expired Japanese Pat. No. 42/14291 for an alloy of similar basic composition to the alloy of the invention illustrates how through an incomplete understanding of the factors controlling anode activation and efficiency, the alloy concerned proved unsuitable in low temperature marine applications, the very conditions for which the alloys of the present invention are designed. Furthermore, the stated preferred casting conditions for the Japanese alloy are quite opposite to those established for the alloys of the present invention.

Broadly, the properties of the alloys of the invention are obtained by a novel alloy composition combined with careful specification of the casting parameters which determine grain size and segregation of the microstructural constituents of the alloy.

In one aspect of the invention, alloys of the following composition are provided:

| | % wt. |
|---|---|
| In | 0.005–0.05 |
| Zn | 0.05–8.0 |
| Mg | 0.02–2.0 |
| Mn | 0.01–0.3 |
| Ga | 0.003–0.05 |
| Fe | 0.03–0.3 |
| Si | 0.03–0.4 |
| Cu | 0.02 max. |
| Grain refiner e.g. Ti—B 0–0.05 max. | |
| Other 0.01 max. | |
| Balance Al. | |

In a preferred embodiment the alloy composition is as follows:

| | | |
|---|---|---|
| In | 0.01–0.03 | |
| Zn | 2.0–6.0 | |
| Mg | 0.1–1.5 | |
| Mn | 0.05–0.2, | more preferably 0.1–0.2 |
| Ga | 0.005–0.02 | |
| Fe | 0.05–0.18, | more preferably 0.01–0.18 |
| Si | 0.01–0.2 | |
| Cu | 0.01 max. | |
| Grain refiner e.g. Ti—B 0–0.02 max. | | |
| Other 0.01 max. | | |
| Balance Al. | | |

In order to achieve the desired properties in the preferred alloys of the invention, the microstructure must be essentially free from primary indium (i.e. indium rejected from solid solution). Besides promoting non-uniform surface activation, primary indium has been found in our development work to increase self-corrosion and so reduce anode capacity.

Grain size is another important factor which should be controlled within an optimum range to ensure maximum anode capacity. The desired optimum grain size of the alloy of the invention is in the range 100–600 μm.

Although complete solubility of magnesium and zinc is preferred, it has been found that low levels can be tolerated in the grain boundaries without substantially affecting the electrochemical or mechanical properties of the alloy.

The composition of the alloy requires careful selection of the alloying elements and their relative proportions. In most cases the effect of one element depends on others and, hence, there is an interdependence of the elements within the composition. Levels above those specified give rise to excessive intermetallic phase formation which increases the degree of local dissolution to unacceptable levels. However, contrary to some accepted beliefs we have found that the nobler intermetallic phases, in particular those containing iron, are important components of the overall activation mechanism and through correct alloying and casting control, can provide both high surface activation and high anode capacity.

Although we do not wish to be limited by any hypothetical or postulated mechanism for the superiority of the new alloys of the invention, we believe that these nobler intermetallic phases through promoting galvanic dissolution of the adjacent matrix may initiate the activation process by providing a continuous supply of activator ions, in this case indium, into the surrounding electrolyte. These ions are subsequently deposited onto the anode surface in line with the generally accepted activation theory.

In order to ensure uniform activation, an optimum density ditribution of the iron containing intermetallic phases is required at the anode surface. This can be achieved by controlling the solidification rate and, hence, grain size and interdendritic arm spacing or through the addition of suitable grain refiners. Unfortunately, in ternary Al—In—Zn alloys the optimum density distribution does not coincide with maximum capacity due to excessive galvanic attack between the matrix and intermetallics. However, the formation of less noble intermetallics through the addition of manganese overcomes this problem enabling the optimum intermetallic density to be used without sacrificing anode capacity. An economic advantage is secured by the ability to use lower purity feedstock and the tolerance to iron pick-up during casting is also increased. The Mn:Fe ratio is most effective when maintained in the range 0.9–1.2:1.

It has been found that in small laboratory size anodes (35 mm dia.×240 mm), the most favourable combination of anode capacity, anode potential and uniformity of anodic dissolution is obtained from anodes with a grain size in the range 100–600 μm. The preferred casting conditions are pouring temperatues between 700°–750° C. combined with the use of steel moulds preheated to 380° to 400° C. It has been found (refer Table 2) that there is a relationship between mould temperature and casting temperature. Broadly, lower mould temperatures require higher casting temperatures with an optimal electrochemical capacity being attained at a casting temperature of 710° C. and a mould temperature of 400° C. (anode 8). Variations which result in either finer or coarser grain structures reduce anode capacity.

Clearly since commercial anode sections vary considerably in size, the optimum casting conditions will also vary. This is especially important in larger anodes in which indium segregation due to the very low cooling rates towards the centre of such anodes will result in non-uniform activation and efficiency losses during the life of the anode. Magnesium reduces the tendency for indium to be rejected from solid solution during solidification by acting as a lattice expander and increasing the solubility of indium in the alloy matrix. Thus besides reducing the level of galvanic attack generated by discrete indium particles in the more slowly cooled central sections of the anode castings and so providing improved consistency, the efficiency of the indium activator is also increased.

These effects increase progressively with increasing magnesium content but due to the formation of undesirable Mg—Zn phases an upper limit of 2% Mg has to be set. Generally only small levels of these phases can be tolerated, but in the presence of copper as an impurity the latter is seemingly absorbed. It appears that by copper being absorbed into these phases its detrimental effect on anode potential and capacity is minimized.

As stated earlier there is an interdependence between the elements in the alloy which, in the case of manganese and magnesium, enhances activation and capacity by limiting the solubility of manganese in the matrix. This ensures that the maximum level of manganese is available to react with the iron containing intermetallics and the matrix retains its high potential. In Al—In—Zn—Mn compositions free of magnesium, anode potentials are less electronegative and reaction with the iron containing intermetallic phases is more sluggish.

Gallium at levels 0.005–0.02% promotes uniform activation of the anode surface and assists in maintaining constant anode potentials during the life of the material. In the alloy of this invention it has been found that sufficient gallium can be introduced into the alloy through sourcing a suitable aluminium feedstock which is known to contain higher than normal levels of gallium. Total gallium levels above 0.01% tend to increase anode consumption, most probably as a result of excessive matrix activation.

Titanium, because it is a well known grain refiner, is added to control grain growth during solidification. Its addition in the established Ti—B form is preferred up to a maximum of 0.020% Ti. Further additions limit the grain size which has been found to have a negative effect on anode capacity. It is believed that because indium has a tendency to segregate and coalesce in grain boundaries and around noble grain boundary precipitates, very fine structures promote excessive indium segregation and, hence, reduce capacity.

The following examples serve to highlight the benefits obtained by the Mg and Mn additions and the effects of casting parameters and harsh environments.

EXAMPLE 1

An alloy of the composition shown in Table 1 was tested against a number of conventional aluminium anode compositions to determine comparative performances. The experimental anodes were cast to size, 35 mm dia.×175 mm, using a preheated graphite coated steel mould. The casting temperature used was 710° C.

The tests were carried out in accordance with DNV TNA 702, a Det Norske Veritas specification involving 96 hours exposure in seawater at 5° C. under impressed current conditions, as outlined below:

| | |
|---|---|
| 1.5 mA.cm-2 for 24 hour<br>0.4 mA.cm-2 for 24 hour<br>4.0 mA.cm-2 for 24 hour<br>1.5 mA.cm-2 for 24 hour | 96 hour total |

The exposure surface area was 100 cm2.

Average result from 3 test anodes for each composition are given in Table 1.

TABLE 1

COMPARATIVE PERFORMANCE OF ALLOYS IN DNV TESTS

| Alloy Type | ANODE COMPOSITION (WT %) In | Hg | Zn | Mn | Mg | Ga | Fe | Si | Ti | Electro-chemical Capacity ($Ah.kg^{-1}$) | Anode* Potential ($mV_{SCE}$) | Anode Consumption |
|---|---|---|---|---|---|---|---|---|---|---|---|---|
| Al—In—Zn | 0.02 | — | 5.0 | — | — | — | 0.08 | 0.1 | 0.015 | 2610 | −1085 | uniform attack some passivity |
| Al—Hg—Zn | — | 0.04 | 4.5 | — | — | — | 0.08 | 0.1 | 0.015 | 2790 | −1045 | non-uniform attack |
| Al—In—Zn—Mg | 0.02 | — | 3.9 | — | 0.85 | 0.01 | 0.11 | 0.1 | 0.015 | 2680 | −1087 | uniform attack |
| Al—In—Zn—Mn | 0.02 | — | 3.8 | 0.15 | — | 0.01 | 0.11 | 0.1 | 0.015 | 2690 | −1080 | uniform attack some passivity |
| **Al—In—Zn—Mg—Mn | 0.02 | — | 3.8 | 0.15 | 0.82 | 0.01 | 0.12 | 0.1 | 0.015 | 2780 | −1096 | uniform attack |

*Anode potential measured at 1.5 $mA.cm^{-2}$
**Alloy of the invention

The anode current capacity of the alloy of the invention was approximately the same as that for the Al—Hg—Zn alloy but significantly higher than that for the remaining Al—In—Zn family of anode alloys. However, the operating potential of alloy's was appreciably higher, i.e. more electronegagtive than the Al—Hg—Zn alloy and it also exhibited a more uniform dissolution pattern. Neither the Al—Hg—Zn nor the Al—In—Zn anodes demonstrated a comparable overall level of performance.

EXAMPLE 2

Figure 10:
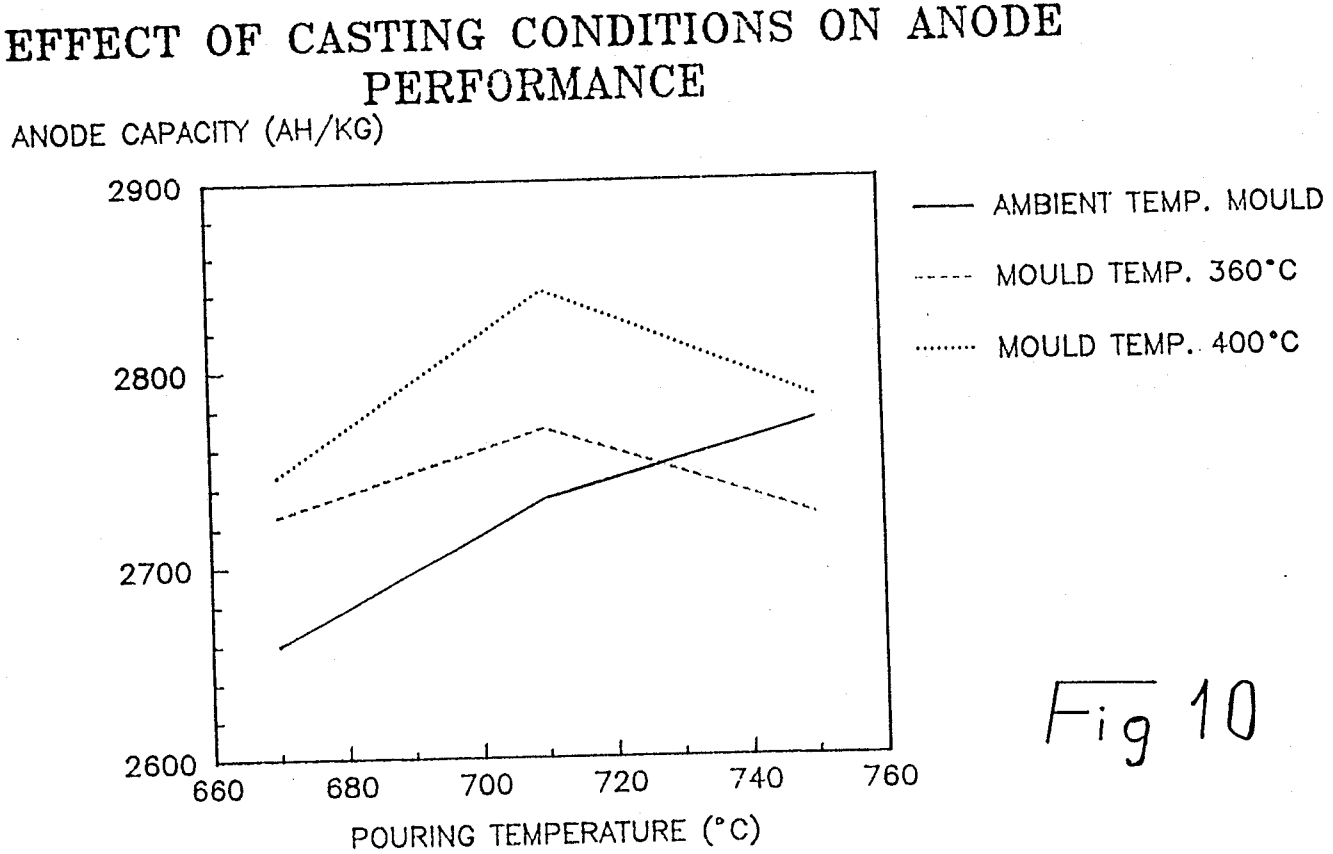

Alloys according to the invention were cast into anodes under varying casting conditions to determine their effect on performance. The alloy composition is shown below. The results are detailed in Table 2 and illustrated in FIG. 10. The relevant microstrucures are shown in FIGS. 1-9.

It is clear from the results that casting conditions must be controlled to obtain a microstructure which promotes both uniform anode dissolution and enhances anode capacity.

| Alloy Composition (wt %): | |
|---|---|
| In | 0.02 |
| Zn | 3.8 |
| Mg | 0.7 |
| Mn | 0.15 |
| Ga | 0.01 |
| Fe | 0.12 |

-continued

| Alloy Composition (wt %): | |
|---|---|
| Si | 0.08 |
| Cu | 0.01 |
| Al | rem. |

TABLE 2

EFFECT OF CASTING CONDITIONS ON ANODE PERFORMANCE

| ANODE | CASTING CONDITIONS (°C.) Melt | Mould | PERFORMANCE Capacity ($Ah.kg^2$) | Potential ($mV_{SCE}$) | Dissolution |
|---|---|---|---|---|---|
| 1 | 670 | 30 | 2660 | 1112 | uniform |
| 2 | 710 | 30 | 2724 | 1126 | uniform |
| 3 | 750 | 30 | 2773 | 1114 | uniform |
| 4 | 670 | 360 | 2726 | 1105 | uniform |
| 5 | 710 | 360 | 2770 | 1118 | uniform |
| 6 | 750 | 360 | 2725 | 1118 | uniform |
| 7 | 670 | 400 | 2746 | 1114 | uniform |
| 8 | 710 | 400 | 2841 | 1115 | uniform |
| 9 | 750 | 400 | 2778 | 1100 | uniform |

EXAMPLE 3

Alloys within the limits of the specified composition range were tested to determine the optimum composition for a range of specific environments. The results in Table 3 show that through appropriate adjustments of alloy composition, relative high performance can be achieved under what can be considered harsh operating conditions.

TABLE 3

ANODE PERFORMANCE IN TYPICAL ENVIRONMENTS

| ENVIRONMENT | COMPOSITION (wt. %) In | Zn | Mg | Mn | Anode Performance Capacity ($Ah.kg^{-1}$) | Potential ($mV_{SCE}$) | Anode Attack Pattern |
|---|---|---|---|---|---|---|---|
| Low Temperature Sea Water (5° C., 500 h, 0.6 $mAcm^{-2}$) | 0.02 | 3.8 | 0.84 | 0.16 | 2794 | −1130 | uniform etch |
| Low Temperature Saline Mud (5° C., 500 h, 0.2 $mAcm^{-2}$) | 0.018 | 3.7 | 1.00 | 0.14 | 2490 | −1064 | uniform etch |
| Ambient Temperature Sea Water (23° C., 1000 h, 0.6 $mAcm^2$) | 0.02 | 3.7 | 0.83 | 0.13 | 2785 | −1120 | light pitting |
| High Temperature Sea Water (95° C., 250 h, 0.2 $mAcm^{-2}$) | 0.02 | 3.7 | 1.23 | 0.13 | 1125 | −1050 | light pitting |

TABLE 3-continued

ANODE PERFORMANCE IN TYPICAL ENVIRONMENTS

| ENVIRONMENT | COMPOSITION (wt. %) In | Zn | Mg | Mn | Anode Performance Capacity ($Ah.kg^{-1}$) | Potential ($mV_{SCE}$) | Anode Attack Pattern |
|---|---|---|---|---|---|---|---|
| High Temperature Saline Mud (95° C., 250 h, 0.2 $mAcm^{-2}$) | 0.02 | 3.8 | 0.84 | 0.16 | 2673 | −1087 | uniform. partial passivation |
| Low Salinity Sea Water (20° C., 500 h, 0.6 $mAcm^{-2}$) | 0.02 | 3.2 | 1.06 | 0.16 | 2718 | −1080 | uniform striated attack |

It will be clearly understood that the invention in its general aspects is not limited to the specific details referred to hereinabove.

I claim:

1. An aluminum alloy consisting essentially of:

| | % wt. |
|---|---|
| In | 0.005–0.05 |
| Zn | 0.05–8.0 |
| Mg | 0.02–2.0 |
| Mn | 0.01–0.3 |
| Ga | 0.003–0.05 |
| Fe | 0.03–0.3 |
| Si | 0.03–0.4 |
| Cu | 0.02 max. |
| Grain refiner e.g. Ti—B | 0.05 max. |
| Other elements | 0.01 max. |
| Al | remainder |

in which the Mn:Fe ratio is in the range of 0.9:1 to 1.2:1, said alloy haing a grain size in the range of 100 to 600 microns.

2. An aluminum alloy according to claim 1 consisting essentially of:

| | % wt. |
|---|---|
| In | 0.01–0.03 |
| Zn | 2.0–6.0 |
| Mg | 0.1–1.5 |
| Mn | 0.05–0.2 |
| Ga | 0.005–0.02 |
| Fe | 0.05–0.18 |
| Si | 0.01–0.2 |
| Cu | 0.01 max. |
| Grain refiner e.g. Ti—B | 0.02 max. |
| Other elements | 0.01 max. |
| Al | remainder |

in which the Mn:Fe ratio is in the range of 0.9:1 to 1.2:1, said alloy having a grain size in the range of 100 to 600 microns.

3. An aluminum alloy according to claim 1 consisting essentially of:

| | % wt. |
|---|---|
| In | 0.01–0.03 |
| Zn | 2.0–6.0 |
| Mg | 0.1–1.5 |
| Mn | 0.1–0.2 |
| Ga | 0.005–0.02 |
| Fe | 0.08–0.18 |
| Si | 0.01–0.2 |
| Cu | 0.01 max. |
| Grain refiner e.g. Ti—B | 0.02 max. |
| Other elements | 0.01 max. |
| Al | remainder |

in which the Mn:Fe ratio is in the range of 0.9:1 to 1.2:1, said alloy having a grain size in the range of 100 to 600 microns.

4. An alloy according to claim 1, having a microstructure essentially free from primary indium.

5. A process for preparing an aluminium alloy of the composition defined in claim 1 which comprises establishing a melt of the said composition and casting the alloy at a pouring temperature between 700° and 750° C. using steel moulds preheated to a temperature between 380° and 400° C.

6. An alloy according to claim 2 having a microstructure essentially free from primary indium.

7. An alloy according to claim 3 having a microstructure essentially free from primary indium.

8. A sacrificial anode composed of an alloy according to claim 1.

9. A sacrificial anode composed of an alloy according to claim 2.

10. A sacrificial anode composed of an alloy according to claim 3.

11. A sacrificial anode composed of an alloy according to claim 4.

* * * * *